US005761766A

United States Patent [19]

Basham

[11] Patent Number: 5,761,766

[45] Date of Patent: Jun. 9, 1998

[54] PISTON DOOR STOP

[76] Inventor: William E. Basham, 5419 Timber Shade, Kingwood, Tex. 77345

[21] Appl. No.: 784,123

[22] Filed: Jan. 15, 1997

[51] Int. Cl.[6] ..... E05F 5/06

[52] U.S. Cl. ..... 16/85; 16/86 A

[58] Field of Search ..... 16/85, 82, 86 R, 16/86 A; 292/181, DIG. 15, 341.12

[56] References Cited

U.S. PATENT DOCUMENTS

| | | | |
|---|---|---|---|
| 2,140,002 | 12/1938 | Dion | 16/86 A |
| 2,479,597 | 8/1949 | Anton | 16/85 |
| 2,540,630 | 2/1951 | Munro | 16/85 |
| 3,160,912 | 12/1964 | Heyer | 16/85 |
| 4,159,837 | 7/1979 | Morita | 16/85 |
| 4,686,740 | 8/1987 | Ishii | 16/85 |

FOREIGN PATENT DOCUMENTS

| | | | |
|---|---|---|---|
| 1143605 | 2/1969 | United Kingdom | 16/85 |

*Primary Examiner*—Chuck Mah

*Attorney, Agent, or Firm*—Goldstein & Associates

[57] ABSTRACT

A piston door stop comprising a hollow first shaft, a hollow second shaft which partially contains said first shaft, a spring, a base screw, and a rubber cap. The spring extends through the bore of both shafts. The first shaft, second shaft, spring, and the rubber cap are coaxial. The door stopper is screwed into a wall via the base screw such that a bottom surface of a head of the base screw is in contact with the surface of said wall. A swung door first hits the rubber cap which covers the second shaft. The force is then transmitted to the spring which is contained within the two shafts, such that the second shaft moves along the first shaft towards the wall, compressing the spring which is contained within both shafts; thus causing the spring to absorb all of the energy transmitted from the swung door.

5 Claims, 4 Drawing Sheets

PISTON DOOR STOP

BACKGROUND OF THE INVENTION

This invention relates to a piston door stop. More particularly, the invention relates to a piston door stop which: i)effectively absorbs the force of a swinging door by means of a spring element; ii)remains firmly fixed to a wall after years of use; and iii) is easily adaptable to use on doors of different sizes and weights.

A great deal of money is spent each year on repairing structural damage to walls and doors resulting from the haphazard swinging of said doors. Although such damage usually appears rather minor, as many homeowners have bitterly discovered, it can be very expensive to repair.

Most doors in residential dwellings are made of wood and are either painted, stained, or have a shiny elegant lacquer coating. Damage to a only a small portion of the door surface requires the entire door to be repainted or refinished. Furthermore, damage to the wall usually requires replastering and repainting which is also very costly.

In response to the damage caused by haphazardly swung doors and the inordinate expense of home repair, two main types of door stoppers have appeared on the market. The first main type of door stopper—the rubber stopper, is a device which has a rubber stopper at one end and projects either from a wall or from a door. The second main type of door stopper is a rubber hollow hemisphere mounted to the wall usually by means of a double sided adhesive tape. When a door hits one of these door stoppers the rubber element in each deforms and partially absorbs the energy of the swinging door.

Both of these door stopper designs have a number of drawbacks. Deformation of the rubber element in either of these devices by the swinging door absorbs some of the force but allows much of the shock of the collision to be transferred to the wall and reflected back to the door. Thus, swinging a door a number of times against these conventional types of rubber door stops might still result in damage to both the door and the wall.

A major drawback of the rubber hemisphere type device which is bonded to the wall is that after repeated use it tends to dislodge from the wall. In time, the attachment of the door stopper to the wall becomes loosened because the attachment (adhesive or double sided adhesive tape) receives the majority of the unabsorbed energy from the swinging door. The attachment of the door stopper to the wall is also loosened because the rubber energy absorbing element is not independent from the attachment to the wall. When the rubber stopper deforms on impact, the surface area of the rubber, which is in contact with the wall and is attached to the wall by means of an adhesive, also deforms; the rubber to wall bond thereby weakens and degrades. Repeated door slamming leads to eventual dislodgment of the hemispherical door stop and thus to an unprotected wall and door.

A further drawback of the conventional door stopper designs is that they are not adaptable to different door weights and sizes. A door stopper with a rubber element capable of partially absorbing the force of a strong door slam of a 100 lb. door generally is not capable of absorbing the force of a strong door slam of a 150 lb. door. As a result, conventional rubber stoppers have to be replaced when doors are replaced and cannot be adapted to new doors of differing weights and sizes.

While these conventional door stoppers may be suitable for the particular purpose employed, or for general use, they would not be as suitable for the purposes of the present invention as disclosed hereafter.

SUMMARY OF THE INVENTION

The present invention discloses a piston door stop with a spring element intended to overcome the deficiencies of door stops disclosed heretofore. It is an object of the invention to produce a door stop with an effective means of absorbing the force of a swung door. A spring inside of the piston door stop is compressed by the swung door and thereby absorbs the kinetic energy of said swung door.

It is another object of the invention to provide a door stop which remains firmly attached to the wall after repeated use. The invention accomplishes this object by incorporating an energy absorbing element, namely a spring, which is independent of the base attaching the door stop to the wall. The deformation/compression of the spring does not shift the base of the door stop. The integrity of the door stop's attachment to the wall is thereby preserved.

It is a further object of the invention to provide a door stop which is easily adaptable to different size and weight doors. The spring in the piston door stop can easily be replaced for a firmer spring for use with larger, heavier doors.

The invention is a piston door stop comprising a hollow first shaft, a hollow second shaft which partially contains said first shaft, a spring, a base screw, and a rubber cap. The spring extends through the bore of both shafts. The first shaft, second shaft, spring, and the rubber cap are coaxial. The door stopper is screwed into a wall via the base screw such that a bottom surface of a head of the base screw is in contact with the surface of said wall. A swung door first hits the rubber cap which covers the second shaft. The force is then transmitted to the spring which is contained within the two shafts, such that the second shaft moves along the first shaft towards the wall, compressing the spring which is contained within both shafts; thus causing the spring to absorb all of the energy transmitted from the swung door.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
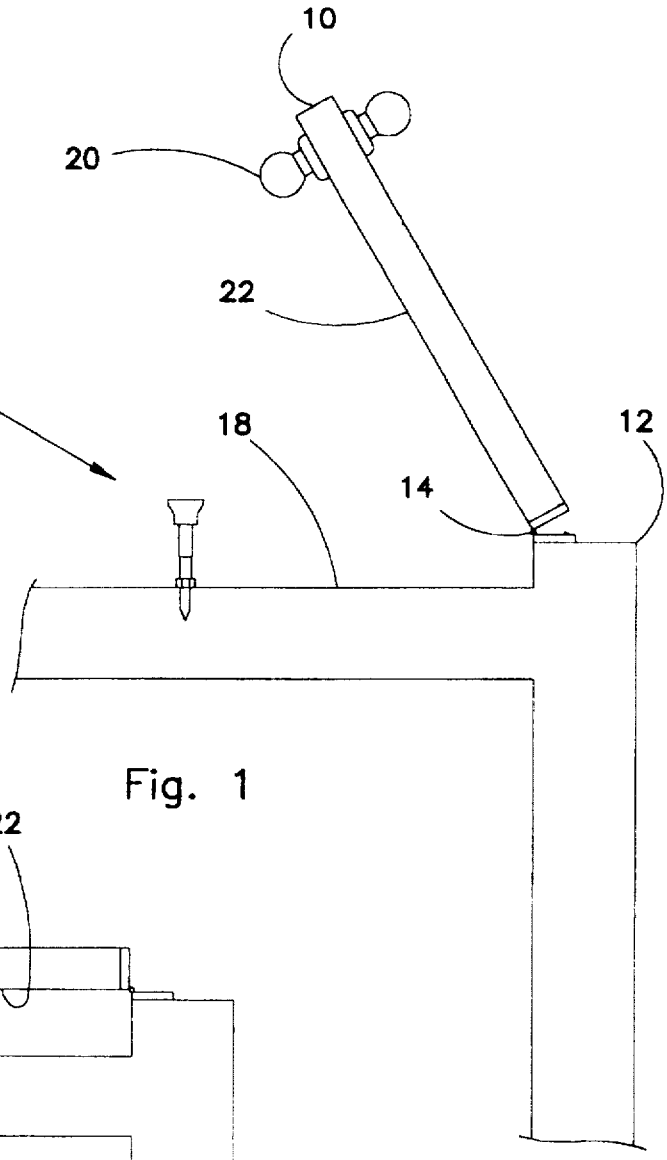
FIG. 1 is a plan view of a partially opened door and a piston door stop screwed into a wall behind the door.

FIG. 1 is a plan view of a partially open door 10 attached to a door frame 12 by means of hinges 14. Said door has a door outer surface 22 and a doorknob 20 secured to said door 10. A piston door stop 16 is attached to a wall 18. The piston door stop 16 is screwed into the wall 18, and projects from the wall toward the door outer surface 22. The piston door stop 16 lies in the path of the swinging door 10. FIG. 1 illustrates the situation existing before the door 10 is swung.

Figure 2:
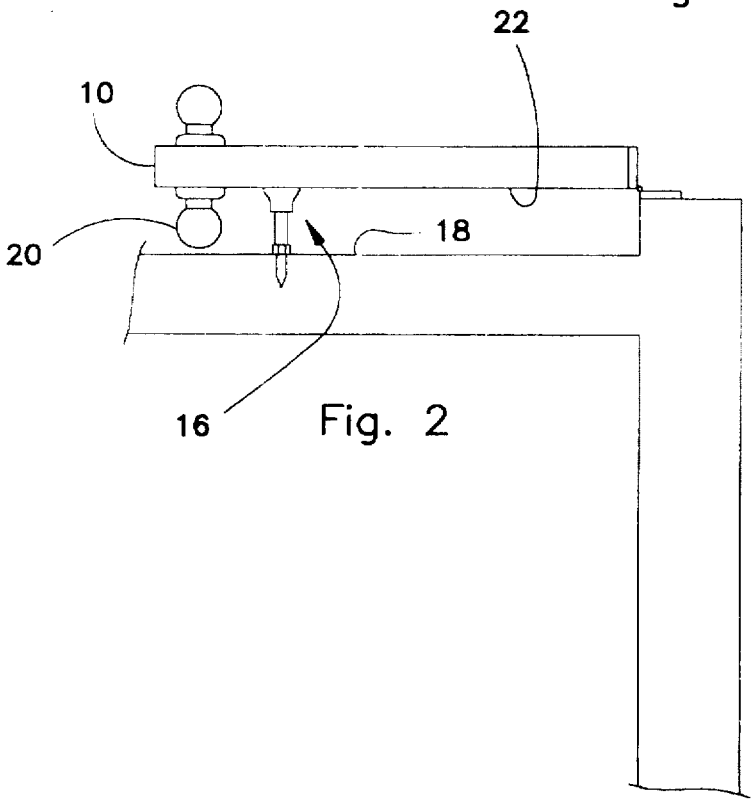
FIG. 2 is a plan view of a completely opened door compressing the piston door stop.

FIG. 2 is a plan view of the door 10 completely open, contacting and compressing the piston door stop 16. The doorknob 20, however, is not permitted to contact the wall 18. The door 10 is applying a force along the longitudinal axis of the piston door stop 16.

Figure 3:
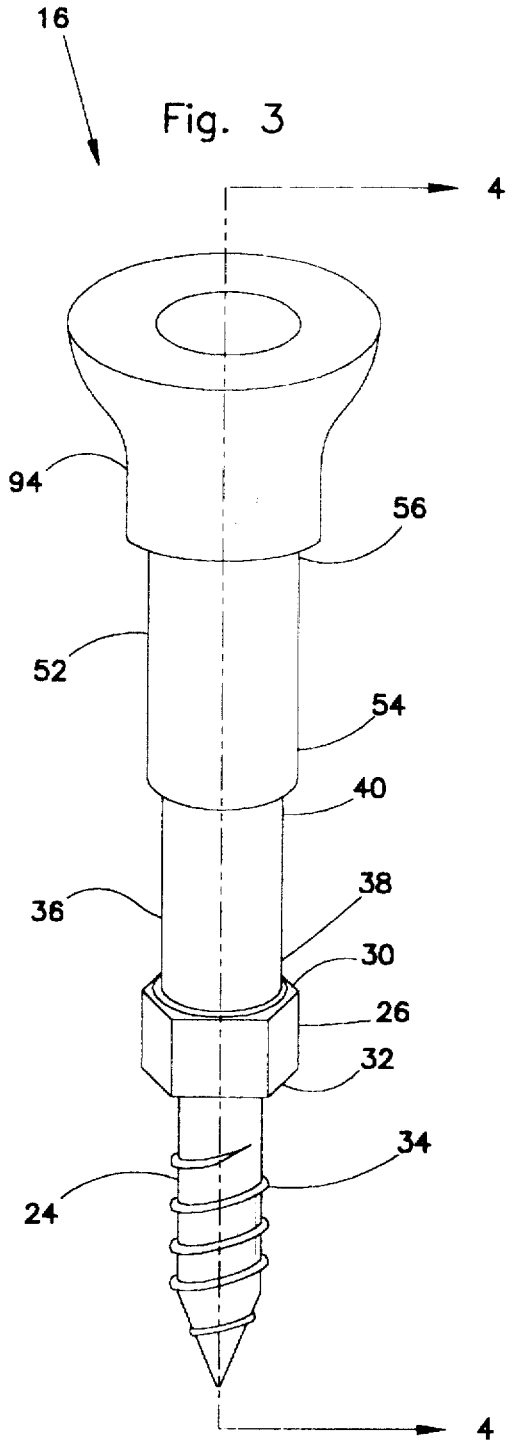
FIG. 3 is a perspective view of the piston door stop.

FIG. 3 is a perspective view of the piston door stop 16 comprising a base screw 24, a first shaft 36, a second shaft 52, and a rubber cap 94. The base screw 24 has a hexagonal base screw head portion 26 and a base screw threaded portion 34. The base screw head portion 26 has a base screw head portion top surface 30 and a base screw head portion bottom surface 32. The first shaft 36 has a first shaft bottom end 38 and a first shaft top end 40. The second shaft 52 has a second shaft bottom end 54 and a second shaft top end 56. The rubber cap 94 fits over the second shaft top end 56. The first shaft bottom end 38 is welded to the base screw head portion top surface 30. The second shaft bottom end 54 envelopes the first shaft top end 40. The base screw 24, first shaft 36, second shaft 52, and rubber cap 94 are coaxial.

Figure 4:
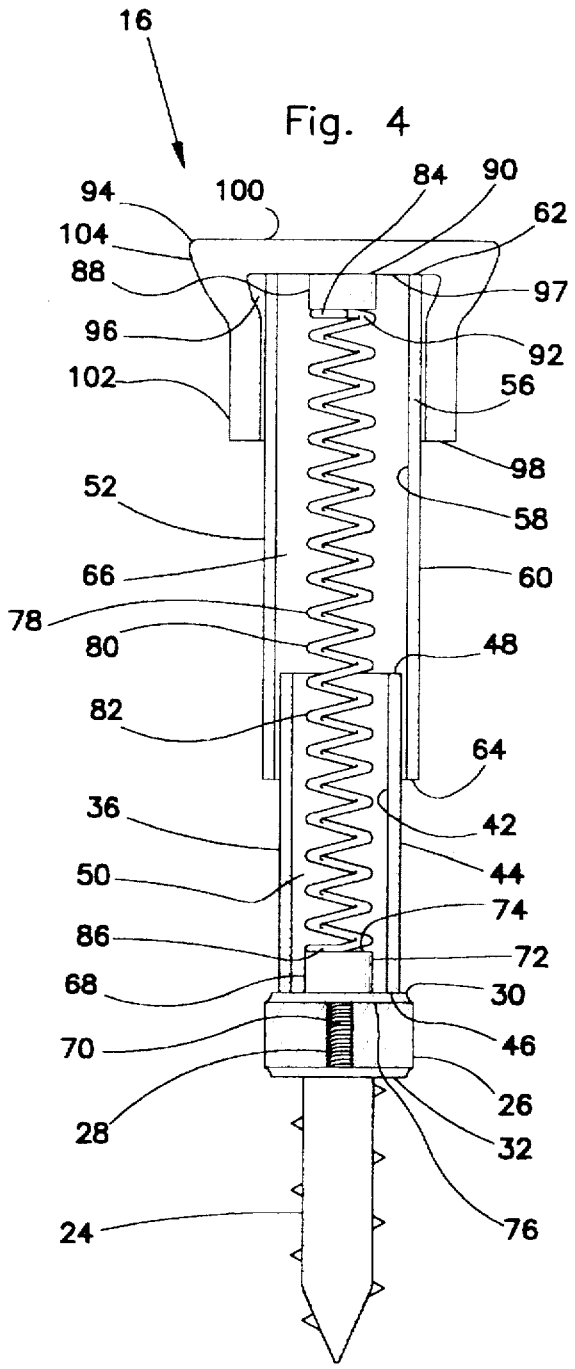
FIG. 4 is a cross sectional view of the piston door stop taken along line 4—4 in FIG. 3.

FIG. 4 illustrates a piston door stop 16 having a rest 68 partially contained within a first shaft bore 50, a spacer 88 contained within a second shaft bore 66, and a spring 78 extending through the first shaft bore 50 and the second shaft bore 66 between the spacer 88 and the rest 68. The spacer 88 has a spacer top surface 90 and a spacer bottom surface 92. The first shaft 36 has a first shaft inner surface 42, a first shaft outer surface 44, a first shaft bottom surface 46, and a first shaft top surface 48. The second shaft 52 has a second shaft inner surface 58, a seconds shaft outer surface 60, a second shaft top surface 62, and a second shaft bottom surface 64. The base screw head portion 26 has a base screw head portion threaded bore 28 in the center extending from the base screw head portion top surface 30 towards the base screw head portion bottom surface 32. The rubber cap 94 has a rubber cap base portion 102, a rubber cap tip portion 104, a rubber cap top surface 100, a rubber cap bottom surface 98, and a rubber cap bore 96 in the center extending from the rubber cap bottom surface 98 toward the rubber cap top surface 100. The second shaft top end 56 fits snugly in the rubber cap bore 96. The rubber cap base portion 102 is disposed about the second shaft top end 56. The rubber cap tip portion 104 has a greater diameter than the second shaft 52, so as to create a greater surface area upon contacting the door 10, thereby decreasing the pressure from impact with the piston door stop 16. The rubber cap tip portion 104 extends beyond the second shaft top surface 62. The rest 68 has a rest threaded portion 70, and a rest head portion 72 with a rest head portion top surface 74 and a rest head portion bottom surface 76. The rest threaded portion 70 is screwed into the base screw head portion threaded bore 28. The rest head portion bottom surface 76 contacts the base screw head portion top surface 30. The spring 78 has a spring upper portion 80, a spring lower portion 82, a spring top surface 84, and a spring bottom surface 86. The spring upper portion 80 is contained within the second shaft bore 66. The spring lower portion 82 is contained within the first shaft bore 50. The spring bottom surface 86 sits on the rest head portion top surface 74. The spring top surface 84 contacts the spacer bottom surface 92. The spacer top surface 90 contacts a rubber cap bore inside top surface 97. The base screw 24, first shaft 36, second shaft 52, rest 68, spring 78, spacer 88, and rubber cap 94 are coaxial.

Referring to FIG. 2 and FIG. 4, a swung door 10 first hits the rubber cap 94 covering the second shaft top end 56. The force is then transmitted to the spring 78 contained within the first shaft bore 50 and within the second shaft bore 66. The second shaft 52 moves along the first shaft outer surface 44 towards the wall 18 and compresses the spring 78.

Figure 5:
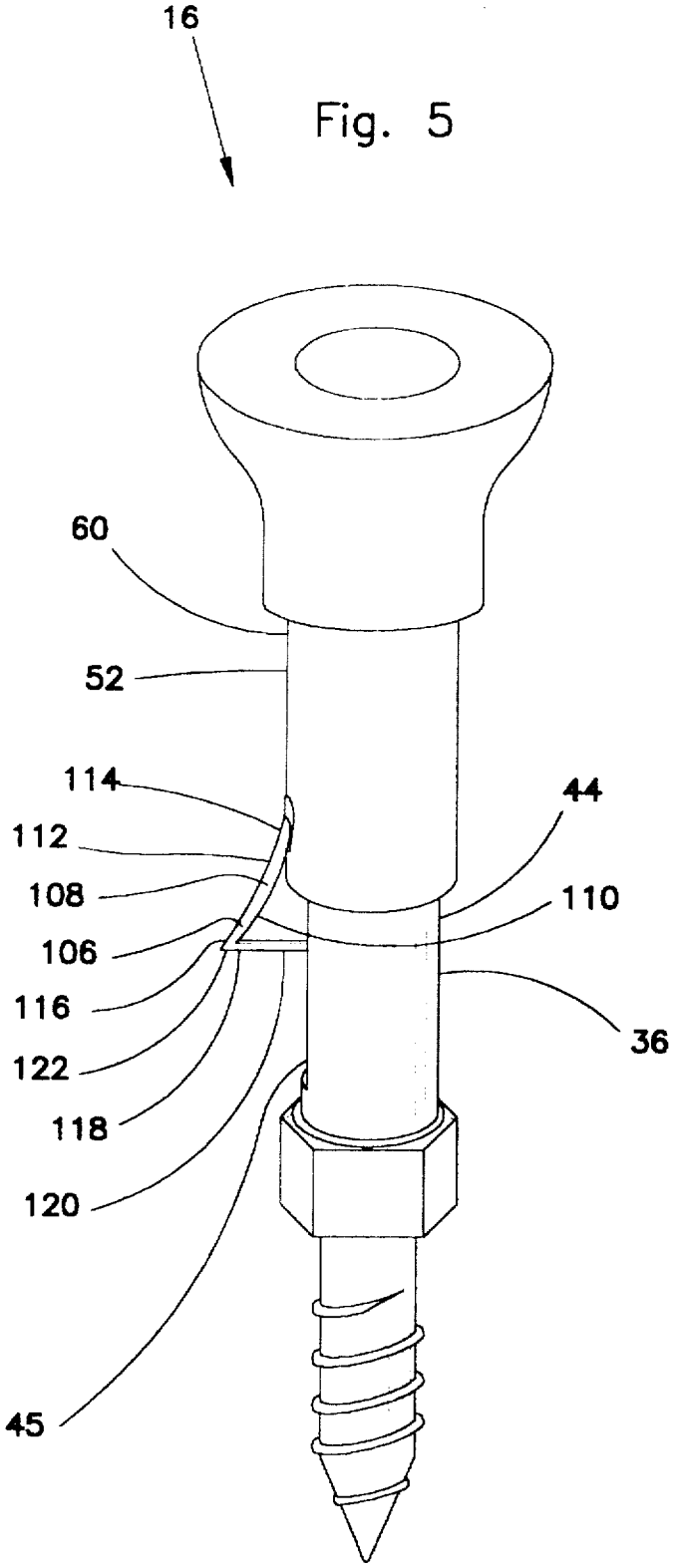
FIG. 5 is a perspective view of the piston door stop with a catch.
Figure 5A:
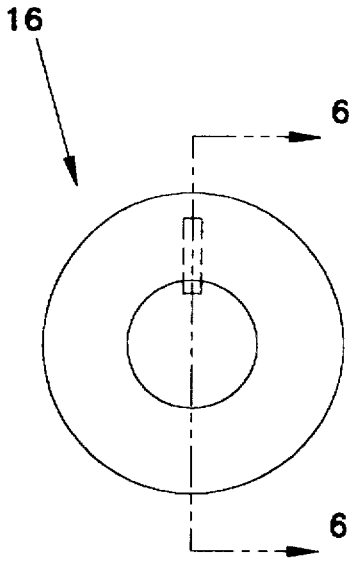
FIG. 5A is a plan view of the piston door stop with a catch.

FIG. 5 illustrates a second embodiment of the piston door stop 16 having a catch 106 attached to the second shaft outer surface 60 and a first shaft groove 45 inscribed in the first shaft outer surface 44. The catch 106 consists of a catch deformed portion 108 and a catch hook portion 118. The catch deformed portion 108 is a straight piece of plastic in its equilibrium state that is bent so as to create a restoring lateral force on the catch hook portion 118. The catch deformed portion 108 has a catch deformed portion top end 114, a catch deformed portion bottom end 116, a catch deformed portion inner surface 110, and a catch deformed portion outer surface 112. The catch deformed portion inner surface 110 of the catch deformed portion top end 114 is attached to the second shaft outer surface 60. The catch hook portion 118 has a catch hook portion outer end 122 and a catch hook portion inner end 120. The catch hook portion outer end 122 is attached to the catch deformed portion bottom end 116. The lateral force of the catch deformed portion 108 forces the catch hook portion 118 into the first shaft groove 45. The catch hook portion 118 projects radially from the first shaft outer surface 44. The catch hook portion inner end 120 travels in the first shaft groove 45.

Figure 6:
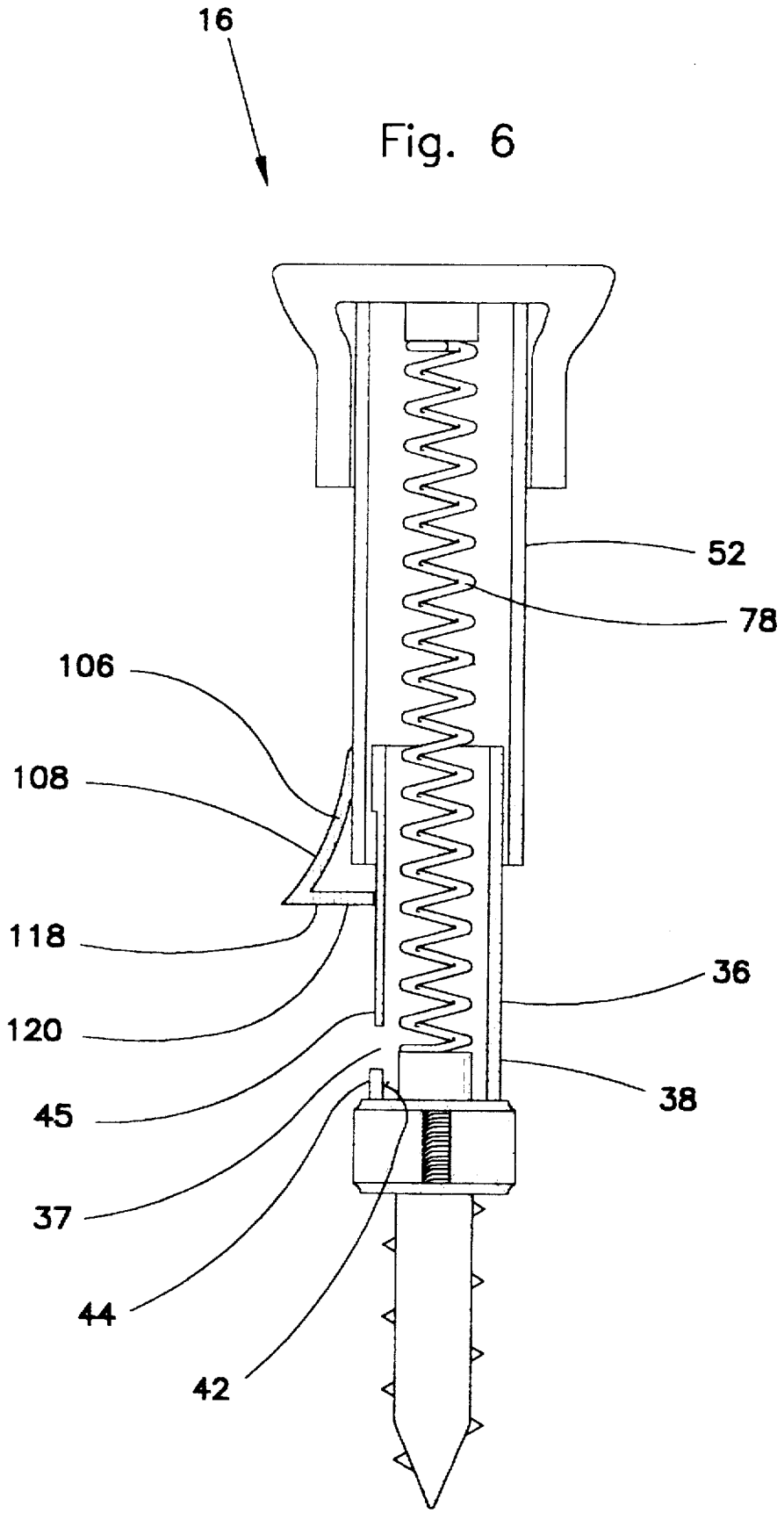
FIG. 6 is cross sectional view of the piston door stop taken along line 6—6 in FIG. 5A.

FIG. 6 illustrates the piston door stop 16 having a first shaft slot 37 in the first shaft bottom end 38. The first shaft slot 37 extends from the first shaft outer surface 44 to the first shaft inner surface 42. The catch hook portion inner end 120 travels in the first shaft groove 45. The first shaft groove 45 extends along the length of the first shaft outer surface 44.

Referring to FIG. 1, FIG. 2, and FIG. 6, after the door 10 is swung, it contacts the piston door stop 16, compresses the spring 78 contained within the shafts, and shifts the second shaft 52 and the catch 106 attached to the second shaft outer surface 60 towards the first shaft slot 37. After traveling a predetermined distance the catch hook portion inner end 120 is forced into the first shaft slot 37. The restoring force of the catch deformed portion 108 forces the catch hook portion 118 into the first shaft slot 37. The catch 106 prevents the spring 78 from returning to its equilibrium position and projecting the second shaft 52 and the door 10 back in the opposite direction.

What is claimed is:

1. A door stop, comprising:

a) an attachment mechanism to secure said door stop to a wall:

b) a first shaft having a first shaft inner surface, a first shaft outer surface, a first shaft bottom end, a first shaft top end, a first shaft top surface, a first shaft bottom surface, and a first shaft bore extending from the first shaft top surface towards the first shaft bottom surface, the first shaft bottom surface is attached to the attachment mechanism;

c) a second shaft with a larger diameter than the diameter of the first shaft, said second shaft having a second shaft inner surface, a second shaft outer surface, a second shaft bottom end, a second shaft top end, a second shaft top surface, a second shaft bottom surface, and a second shaft bore extending from the second shaft bottom surface towards the second shaft top surface, the diameter of the second shaft bore is greater than the diameter of the first shaft, the second shaft bottom end envelopes the first shaft top end; and d) a spring which is longer than the first shaft having a spring top surface, a spring bottom surface, a spring upper section, and a spring lower section, said spring has a spring winding diameter which is smaller than the diameter of the first shaft bore and smaller than the diameter of the second shaft bore, the spring lower section is located inside the first shaft bore, the spring upper section extends beyond the first shaft top surface and into the second shaft bore, the first shaft, second shaft, and spring are coaxial e) a locking means for locking the second shaft in place after it has traveled a predetermined distance along the first shaft outer surface towards the attachment mechanism, wherein the locking means comprise a catch having a catch deformed portion and a catch hook portion, the catch deformed portion has a catch deformed portion top end and a catch deformed portion bottom end, a catch deformed portion inner surface, a catch deformed portion outer surface, the catch deformed portion inner surface of the catch deformed portion top end is attached to the second shaft outer surface, the catch deformed portion bottom end extends beyond the second shaft bottom surface and said catch deformed portion bottom end is further distant from the second shaft outer surface than the catch deformed portion top end, the catch hook portion has a catch hook portion outer end, a catch hook portion inner end, and has a greater length than the distance between the second shaft outer surface and the second shaft inner surface, the catch hook portion outer end is attached to the catch deformed portion bottom end so that the catch hook portion inner end is forced into a first shaft groove in the first shaft outer surface, said first shaft groove extends along the first shaft outer surface, has a groove top end, and a groove bottom end, the catch hook portion inner end is caught in a slot in the first shaft bottom end directly below the groove bottom end.

2. The door stop as in claim 1 wherein the attachment mechanism consists of a base screw having a base screw head portion and a base screw threaded portion, the base screw head portion has a base screw head portion bottom surface, and a base screw head portion top surface, the base screw head portion top surface is attached to the first shaft bottom surface, said first shaft, second shaft, spring, and base screw are coaxial.

3. The door stop as in claim 2 wherein the first shaft bottom surface is welded to the base screw head portion top surface.

4. The door stop as in claim 3 further comprising a rest having a rest head portion, and a rest threaded portion, the rest head portion has a rest head portion top surface, a rest head portion bottom surface, and a smaller diameter than the first shaft bore, the rest head portion is contained within the first shaft bottom end, the rest head portion bottom surface is flush with the first shaft bottom surface, the rest threaded portion extends beyond the first shaft bottom surface and is screwed into a base screw head portion threaded bore in the center of the base screw head portion, said base screw head portion threaded bore extends from the base screw head portion top surface towards the base screw head portion bottom surface, the spring bottom surface which is contained within the first shaft bore and within the second shaft bore sits on the rest head portion top surface, the first shaft, second shaft, spring, base screw, and rest are coaxial.

5. The door stop as in claim 2 further comprising a cap covering the second shaft top end, the first shaft, second shaft, spring, base screw, and cap are coaxial.

* * * * *